US008677765B2

(12) United States Patent
Gerendas

(10) Patent No.: US 8,677,765 B2
(45) Date of Patent: Mar. 25, 2014

(54) GAS-TURBINE COMBUSTION CHAMBER WITH A HOLDING MECHANISM FOR A SEAL FOR AN ATTACHMENT

(75) Inventor: Miklos Gerendas, Am Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 13/444,284

(22) Filed: Apr. 11, 2012

(65) Prior Publication Data

US 2013/0055716 A1 Mar. 7, 2013

(30) Foreign Application Priority Data

Apr. 13, 2011 (DE) ..... 10 2011 016 917

(51) Int. Cl.
*F02C 7/20* (2006.01)

(52) U.S. Cl.
USPC ..... 60/796; 60/753

(58) Field of Classification Search
USPC ..... 60/796, 798, 39.821–39.828, 752–760
See application file for complete search history.

(56) References Cited

U.S. PATENT DOCUMENTS

| | | | | |
|---|---|---|---|---|
| 3,910,036 | A * | 10/1975 | Irwin | 60/753 |
| 3,911,672 | A | 10/1975 | Irwin | |
| 3,922,851 | A * | 12/1975 | Irwin | 60/800 |
| 4,237,389 | A | 12/1980 | Allen | |
| 6,397,603 | B1 | 6/2002 | Edmondson et al. | |
| 6,438,940 | B1 | 8/2002 | Vacek et al. | |
| 7,101,173 | B2 | 9/2006 | Hernandez et al. | |
| 2005/0072163 | A1 | 4/2005 | Wells et al. | |
| 2006/0000260 | A1 * | 1/2006 | Benson et al. | 73/35.08 |
| 2007/0128002 | A1 * | 6/2007 | Geary | 411/511 |
| 2008/0010990 | A1 | 1/2008 | Shi et al. | |
| 2010/0242486 | A1 * | 9/2010 | Jarmon et al. | 60/768 |

FOREIGN PATENT DOCUMENTS

| | | |
|---|---|---|
| DE | 602004000790 | 5/2007 |
| EP | 1148300 | 10/2001 |
| EP | 1962018 | 8/2008 |
| JP | 8093504 | 4/1996 |
| WO | 2010/077764 | 7/2010 |

OTHER PUBLICATIONS

German Search Report dated Dec. 8, 2011 from counterpart application.

* cited by examiner

*Primary Examiner* — Phutthiwat Wongwian
*Assistant Examiner* — Scott Walthour
(74) *Attorney, Agent, or Firm* — Timothy J. Klima; Shuttleworth & Ingersoll, PLC

(57) ABSTRACT

Gas-turbine combustion chamber with a combustion chamber head made from a metallic material and mounting at least one burner, and with a combustion chamber wall made from a ceramic material, where at least one igniter plug or other combustion chamber attachment is arranged in a recess of the combustion chamber wall, and where in the area of the recess a seal is arranged that is mounted by a metallic holding mechanism from another component than the combustion chamber wall.

8 Claims, 6 Drawing Sheets

Figure 1:
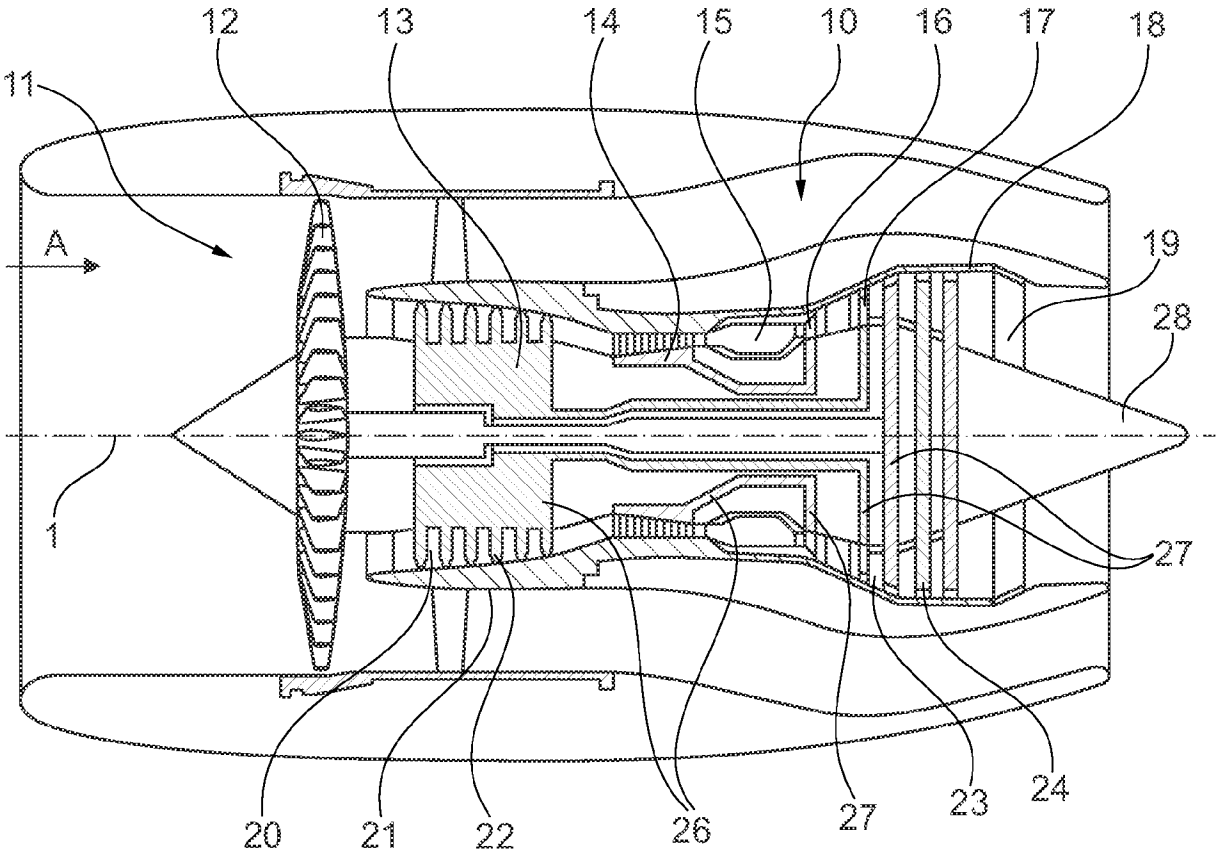

GAS-TURBINE COMBUSTION CHAMBER WITH A HOLDING MECHANISM FOR A SEAL FOR AN ATTACHMENT

This application claims priority to German Patent Application DE102011016917.2 filed Apr. 13, 2011, the entirety of which is incorporated by reference herein.

The invention relates to a gas-turbine combustion chamber with a combustion chamber head made from a metallic material and mounting a burner, and with a combustion chamber made from a ceramic material, in particular from a ceramic matrix reinforced with ceramic fibres (CMC).

The invention further relates to a holding means of a seal on a CMC combustion chamber, for example for an igniter plug or an attachment.

U.S. Pat. No. 6,397,603 A presents a combustion chamber where a combustion chamber wall designed as a single shell consists of a ceramic matrix reinforced with ceramic fibres (CMC) and where said CMC combustion chamber wall is flexibly connected to a metallic combustion chamber head to equalize the different thermal expansions.

The CMC material of a combustion chamber is still very strain-intolerant even with drastically improved properties compared with monolithic ceramics. The impact of a bird or other foreign objects or of a fragment of a compressor component on the CMC must therefore be prevented. This task is assigned to the metallic combustion chamber head. The necessary metallic combustion chamber head can also be used for mounting the combustion chamber in the engine, as set forth in U.S. Pat. No. 6,397,603 A, or this task is assumed by holding means at the other end of the combustion chamber at the transition in the direction of the turbines. Regardless of this, the CMC combustion chamber walls are connected to the metallic head by correspondingly flexible solutions. WO 2010/077764 A and EP 1962018 A1 show sealed connections of acoustic dampers with differing modes of operation on a metallic combustion chamber.

The CMC wall material can also be used in the temperature range above 1200° C., which would not be possible for metallic materials. Due to the high working temperature of the CMC combustion chamber wall a drastic saving in cooling air is possible, which air can be used either to reduce exhaust emissions or to cool other components. This cooling air saving is only achieved when all leakage points of the combustion chamber are sealed. These also include access holes for igniter plugs, pressure sensors or other attachments and/or installations. In the following only the igniter plug is mentioned for the sake of simplicity, since it is the most frequent application, without neglecting the other applications by doing so. In metallic combustion chambers, the holders for the igniter plug seals are usually welded to the combustion chamber wall, which also provides the flat sealing or sliding surface, respectively. The relative movements between the combustion chamber wall and the casing in which the igniter plug is attached, resulting from the differing thermal expansions of the two components, can be divided into a radial and an axial movement relative to the engine axis. The radial relative movement is enabled by the sliding of the igniter plug in the igniter plug seal and the axial relative movement by the sliding of the igniter plug seal on the combustion chamber wall, where the opening in the combustion chamber wall must be designed larger to match the relative movement.

The known seal has the shape also known from metallic combustion chambers with an L-shaped or V-shaped cross-section. The collar with a first diameter perpendicular to the axis of the holes through the seal is in contact with the flat surface of the combustion chamber and seals off the igniter plug from the combustion chamber, but permits the axial relative movement between the combustion chamber and the igniter plug. The hole through the seal receives the igniter plug and permits the radial relative movement between combustion chamber and igniter plug. During assembly, the igniter plug is passed through a funnel with a second and slightly smaller outer diameter to the hole, without any fear of damage to the igniter plug or to the seal. After insertion of the igniter plug, the seal can now only slide along the axis of the igniter plug and during operation the insertion funnel has no function.

A design of a cooling air-reduced CMC combustion chamber without igniter plug seal makes little sense, since the cooling air saved in wall cooling would escape unused through the gap between the combustion chamber wall and the igniter plug necessary for compensating for relative movements. However, the CMC material cannot be welded. Brazing is possible under certain conditions, but the brazing temperature of the available brazing solders is drastically below the temperature limit of the CMC, so that the major advantage of the high working temperature of the CMC combustion chamber wall would be negated.

The present invention, in a broad aspect, provides a gas-turbine combustion chamber of the type specified at the beginning which, while being provided with an easily and cost-effectively producible holding means for the igniter plug seal, avoids the disadvantages known from the state of the art.

It is a particular object of the present invention to provide solution to the above problems by a combination of the features described herein. Further advantageous embodiments of the present invention become apparent from the present description.

The invention thus provides a gas-turbine combustion chamber with a combustion chamber head made from a metallic material and mounting a burner, and with combustion chamber walls made from a ceramic material, where at least one igniter plug is arranged in a recess (aperture) of the combustion chamber, and where in the area of the recess a seal is arranged that is mounted radially outside the igniter plug by means of a metallic holding means.

In a particularly favourable development of the invention, it is provided that the holding means is designed bar-like and has a recess for receiving the seal. The seal is preferably provided with an insertion funnel for fitting the igniter plug. The recess of the holding means is dimensioned such that the insertion funnel can be passed through this recess of the holding means.

The holding means is in accordance with the invention preferably fastened to a metallic component, for example to the combustion chamber head or to a component mounting the combustion chamber. The holding means can here be designed in accordance with the invention in one piece with the metallic component mounting it, or joined to the latter or connected to the component by means of a fastening element (bolt or similar).

It is thus provided in accordance with the invention that the seal is fixed in the CMC combustion chamber wall by a bar-like metallic holding means having a hole to receive the seal proper from a nearby metallic component via the access hole for the igniter plug.

This nearby component can be the metallic combustion chamber head or a metallic component used for suspension of the CMC combustion chamber in the metallic casings of the engine. The bar-like metallic holding means can be designed in one piece with the other metallic component, for example the combustion chamber head, or joined to it for example by brazing, or fastened to the other component using at least one fastening element such as a bolt or rivet.

The bar-like holding means can also be fastened to the outer combustion chamber casing or to the igniter plug adapter fitted into the outer combustion chamber casing. To compensate for the radial relative movement between the combustion chamber and the casing by elastic deformation, the bar-like holding means is not designed purely radial. Advantageously, it is designed in the form of a helix or a wave-shaped or trapezoidal support for the connection to the igniter plug adapter.

The hole in the bar-like metallic holding means is large enough to admit the insertion funnel of the seal (of slightly smaller diameter), but not the seal collar (of slightly larger diameter) positioned vertically to the hole axis. The bar-like metallic holding means is at a distance from the combustion chamber wall. It can have a simple rectangular cross-section, which is particularly advantageous in the case of a connection to the igniter plug adapter, or for increasing the stiffness against vibrations a cross-section with a higher moment of inertia, for example a V-shaped cross-section, in particular advantageous in the case of a connection to the combustion chamber head.

The flat surface necessary as a sealing surface is provided by a local thickening of the CMC combustion chamber wall, which during production of the combustion chamber wall is made from the same material as the combustion chamber wall itself, with the additional CMC material on the inside of the combustion chamber being added, while retaining a circular inner contour of the combustion chamber, inside the combustion chamber wall by one or more inserts or on the outside of the combustion chamber by an addition of CMC material.

The bar-like metallic holding means is used for positioning of the seal during assembly. In operation, the seal is pressed by the prevailing pressure difference between the combustion chamber outer and inner sides against the sealing surface, meaning that a pressing mechanism such as a spring is not necessary during operation. To allow this sealing effect to develop during starting of the engine, the seal must be located at least in the vicinity of the opening in the combustion chamber wall. It is therefore sufficient, when the bar-like metallic holding means for the igniter plug seal positions the seal with a few millimeters of clearance at the igniter plug opening in the combustion chamber wall.

The bar-like metallic holding means must not have any contact with the ceramic combustion chamber wall, since the thermal expansion coefficients of metal and CMC drastically differ. If the bar-like metallic holding means were to be in contact with or too close to the CMC combustion chamber in the cold state, there would be a risk of damage to the holding means or the combustion chamber due to the forces resulting from thermal distortion. Furthermore, the CMC combustion chamber develops very high temperatures in operation, which could damage the bar-like metallic holding means. In addition, the cooling air for the combustion chamber wall must have underneath the bar-like metallic holding means too free access to the cooling air openings located in the CMC combustion chamber wall if it is to perform its task.

An alternative solution for providing a flat surface for the seal on the round combustion chamber would be a local milling off of the combustion chamber wall. If the remaining wall thickness after that operation is sufficient to absorb all forces in operation, then the wall thickness outside the flat sealing surface is over-dimensioned and the unnecessarily large wall thickness of the component increases the weight of the combustion chamber and also the component costs. By the proposed local thickening of the combustion chamber with material of the same type, the remaining combustion chamber wall can be designed in the precisely necessary thickness and a flat surface is available for effective sealing on this component optimized in both cost and weight.

The present invention applies to both, annular combustion chambers and tubular combustion chambers with CMC combustion chamber walls.

Figure 2:
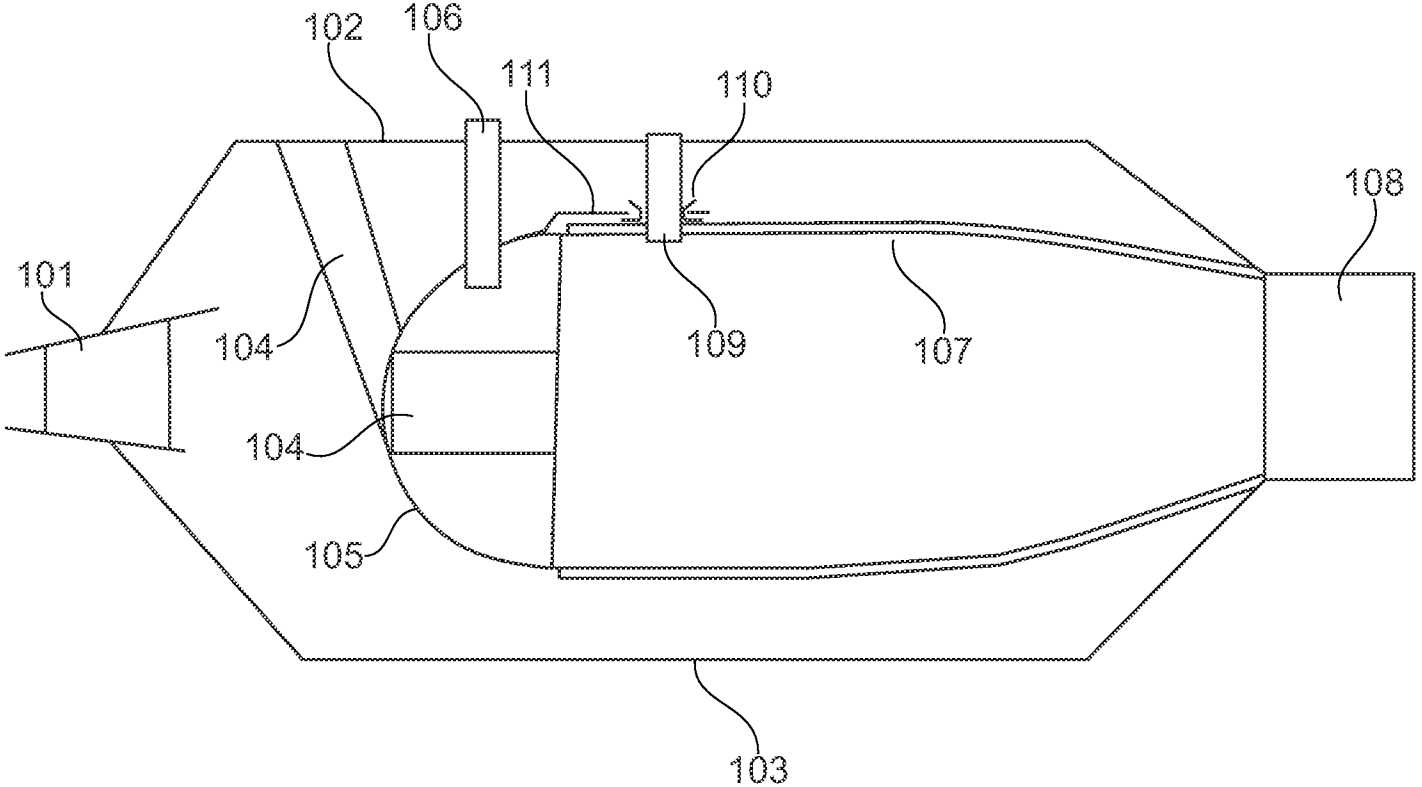
Figure 3:
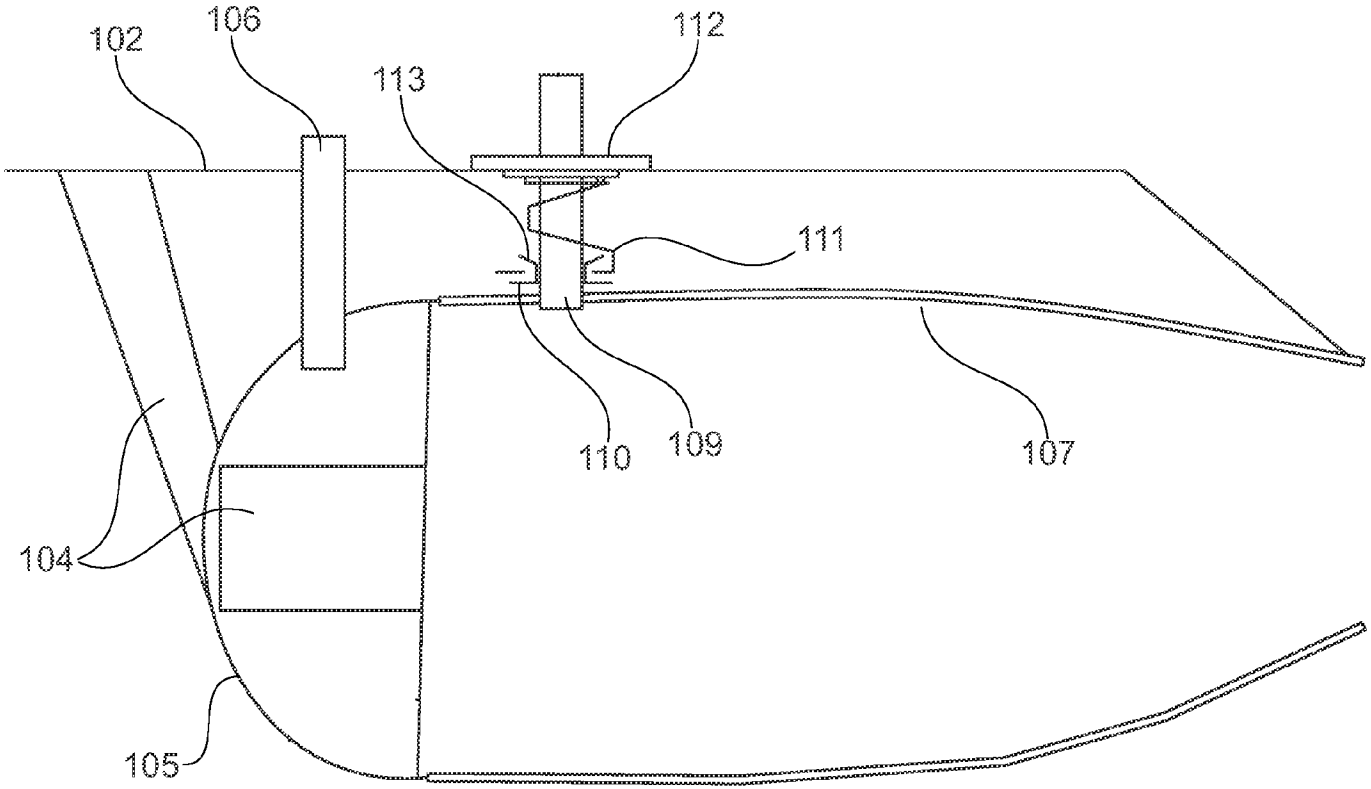
Figure 4:
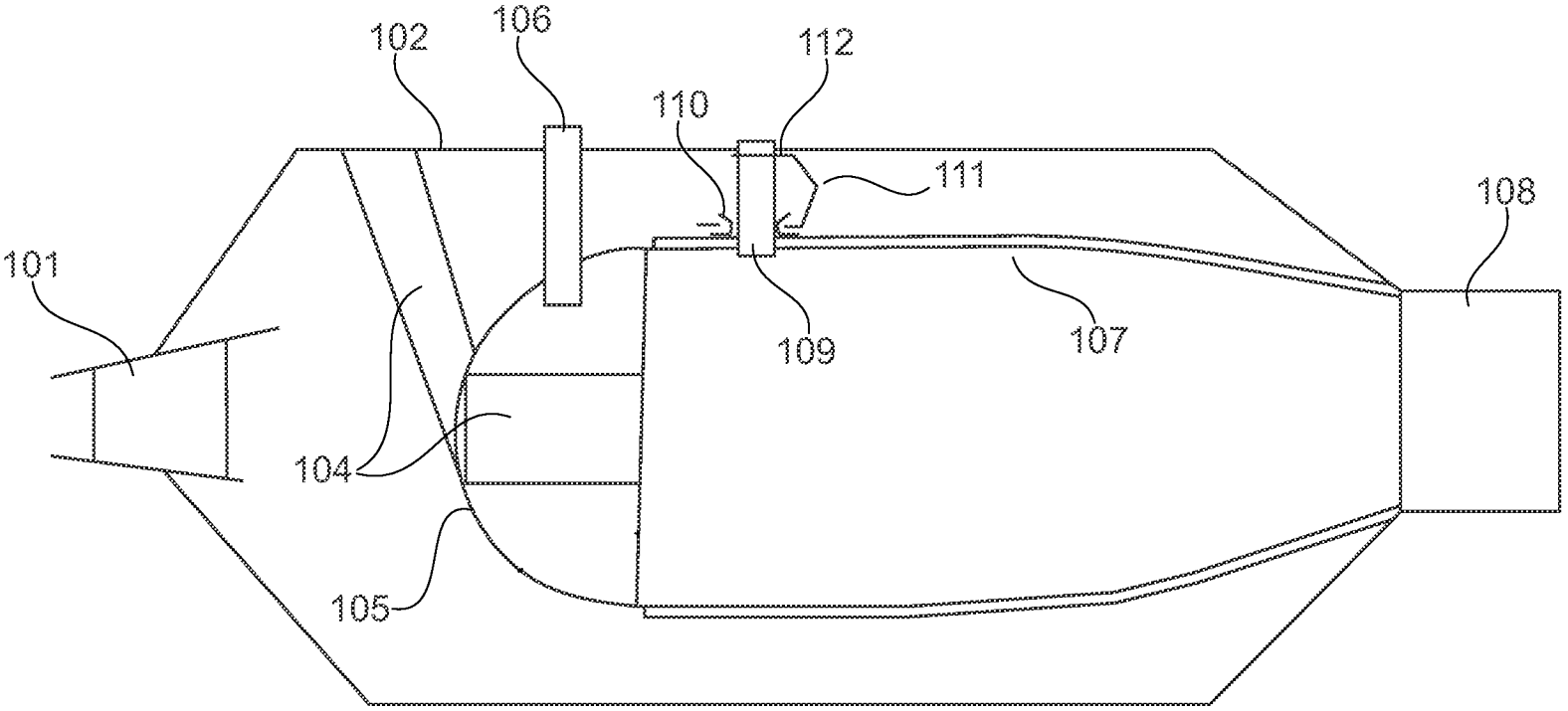
Figure 5A:
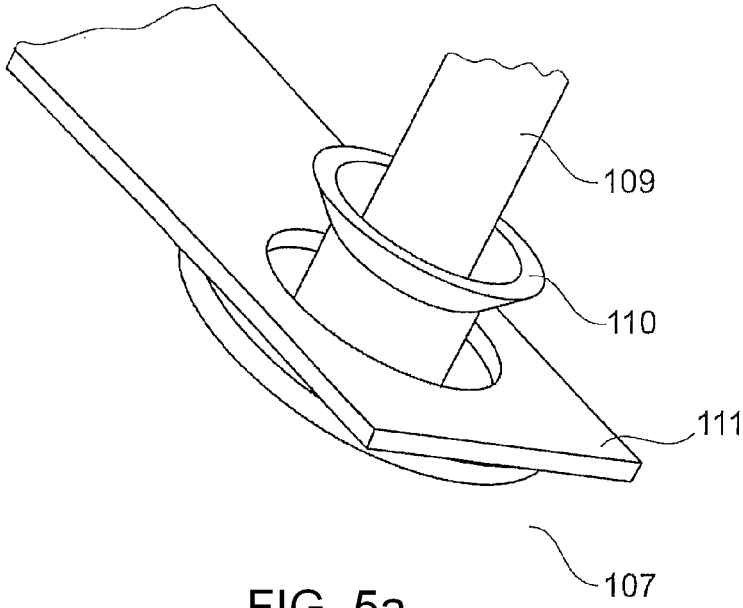
Figure 5B:
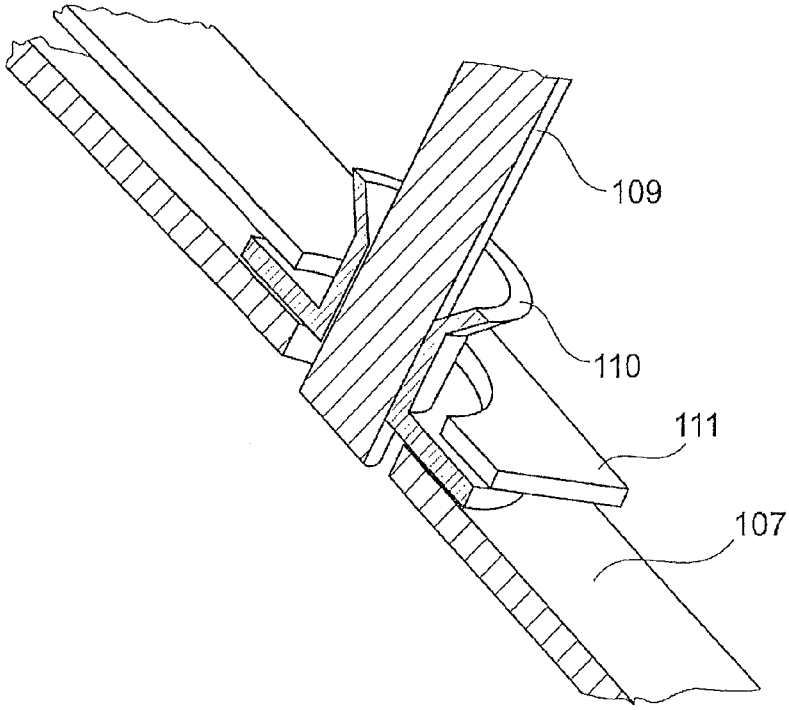
Figure 6:
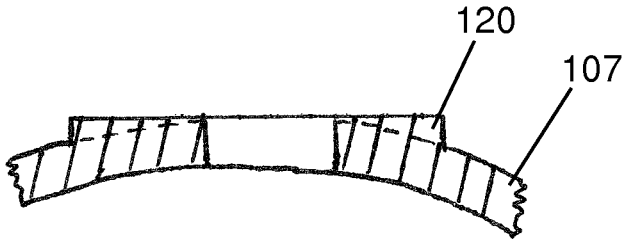

The invention is described in the following in light of the accompanying drawing, showing preferred exemplary embodiments. In the drawing, FIG. 1 shows a schematic representation of a gas-turbine engine in accordance with the present invention, FIG. 2 shows a simplified schematic axial sectional view of a first exemplary embodiment of the invention, FIG. 3 shows a sectional view, by analogy with FIG. 2, of a further exemplary embodiment, FIG. 4 shows a sectional view, by analogy with FIGS. 2 and 3, of a third exemplary embodiment of the invention, FIG. 5*a* shows a three-dimensional view of the mounted device, FIG. 5*b* shows a three-dimensional section through the mounted device; and FIG. 6 shows a sectional view of a further embodiment of the present invention.

In the exemplary embodiments, identical parts are provided with the same reference numerals.

The gas-turbine engine 10 in accordance with FIG. 1 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, combustion chambers 15, a high-pressure turbine 16, an intermediate-pressure turbine 17 and a low-pressure turbine 18 as well as an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

FIGS. 2 to 4 each show in an axial sectional view simplified representations of exemplary embodiments in accordance with the invention. FIG. 5*a* shows a three-dimensional view of the device in accordance with the invention and FIG. 5*b* a three-dimensional section through the device. FIG. 6 shows a flattening 120 of the combustion chamber wall 107 in the area of the recess for providing a sealing surface is generated by a local thickening of the wall, which at the recess substantially again reaches the wall thickness of the surrounding wall.

In accordance with the invention, a combustion chamber 107 includes a CMC combustion chamber wall. Upstream of the combustion chamber 107, a burner 104 with an arm and a head is arranged, which is mounted by means of a metallic combustion chamber head 105. The flow is supplied via compressor outlet blades 101. The entire arrangement is provided in a combustion chamber outer casing 102 and a combustion chamber inner casing 105. The reference numeral 106 shows a combustion chamber holding means, for example by means of three pins distributed over the circumference. Turbine inlet blades 108 are arranged downstream of the combustion chamber 107.

The figures furthermore each show an igniter plug 109 sealed by means of an igniter plug seal (seal) 110. The igniter plug is mounted by means of an igniter plug adapter 112 attached to the combustion chamber outer casing 102.

In accordance with the invention, a metallic bar-like holding means 111 is provided which mounts the igniter plug seal.

FIG. 2 shows an exemplary embodiment in which the metallic bar-like holding means 111 is fastened to the metallic combustion chamber head 105. In a variant embodiment in accordance with FIG. 3, the metallic bar-like holding means 111 is held on the combustion chamber outer casing 102 or an igniter plug adapter 112, respectively. The metallic bar-like holding means 111 in accordance with the exemplary embodiment shown in FIG. 3 is designed such that a radial relative movement is possible.

FIG. 3 furthermore shows an insertion funnel 113 used for insertion of the igniter plug 109.

In the exemplary embodiment shown in FIG. 4, the metallic bar-like holding means is designed angled and mounted on the igniter plug adapter 112 or the combustion chamber outer casing 102, respectively.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Combustion chambers
16 High-pressure turbine
17 Intermediate-pressure turbine
18 Low-pressure turbine
19 Exhaust nozzle
20 Guide vanes
21 Engine casing
22 Compressor rotor blades
23 Guide vanes
24 Turbine blades
26 Compressor drum or disk
27 Turbine rotor hub
28 Exhaust cone
101 Compressor outlet blade
102 Combustion chamber outer casing
103 Combustion chamber inner casing
104 Burner with arm and head
105 Metallic combustion chamber head
106 Combustion chamber holding means
107 CMC combustion chamber wall
108 Turbine inlet blade
109 Attachments and/or installations: igniter plug, sensors, acoustic dampers, air valves
110 Seal for attachments and/or installations
111 Metallic bar-like holding means of seal
112 Adapter/holding means of the attachments and/or installations
113 Insertion funnel

What is claimed is:

1. A gas turbine combustion chamber comprising:

a combustion chamber head made from a metallic material and mounting at least one burner, a combustion chamber wall made from a ceramic material and having an aperture, at least one chosen from an igniter plug and other combustion chamber attachments is arranged in the aperture of the combustion chamber wall, and a seal arranged in an area of the aperture, a metallic holding mechanism mounting the seal, the metallic holding mechanism supported from a component other than the combustion chamber wall;

the holding mechanism having a rectangular cross-section and including both a radial degree of freedom and a degree of freedom transverse to the radial degree of freedom, enabling a relative movement of the seal with respect to the combustion chamber wall in both a radial direction and a direction transverse to the radial direction;

wherein the holding mechanism comprises a leaf spring having a seal receiving aperture therethrough for receiving a portion of the seal; the seal having a longitudinal axis and an enlarged portion positioned between the holding mechanism and the combustion chamber wall, the enlarged portion having a dimension transverse to the longitudinal axis that is larger than a dimension of the seal receiving aperture such that the seal is retained between the holding mechanism and the combustion chamber wall.

2. The gas turbine combustion chamber of claim 1, wherein the holding mechanism is fastened to a metallic component.

3. The gas turbine combustion chamber of claim 2, wherein the holding mechanism is fastened to the combustion chamber head.

4. The gas turbine combustion chamber of claim 2, wherein the holding mechanism is fastened to a component mounting the combustion chamber wall.

5. The gas turbine combustion chamber of claim 1, wherein the holding mechanism is at least one chosen from integral with the metallic component mounting it, joined to the component mounting it and connected to the component mounting it by a fastening element.

6. The gas turbine combustion chamber of claim 1, wherein the seal includes an insertion funnel for fitting the combustion chamber attachments and that the insertion funnel can be passed through an aperture of the holding mechanism.

7. The gas turbine combustion chamber of claim 1, the combustion chamber wall comprising a sealing area surrounding the aperture, the sealing area including a local thickening of the wall, wherein the sealing area has a thickness which is substantially a same thickness as a predominating thickness of the combustion chamber wall at the aperture and a local thickening having a thickness which is thicker than the predominating thickness of the combustion chamber wall away from the aperture.

8. The gas turbine combustion chamber of claim 1, wherein the other combustion chamber attachments include at least one chosen from an acoustic damper, a sensor and a valve.

* * * * *